US008420932B2

(12) United States Patent
Miyazawa et al.

(10) Patent No.: US 8,420,932 B2
(45) Date of Patent: Apr. 16, 2013

(54) CERAMIC TUBE FOR HIGH-INTENSITY DISCHARGE LAMP AND METHOD OF PRODUCING THE SAME

(75) Inventors: Sugio Miyazawa, Kasugai (JP); Keiichiro Watanabe, Kasugai (JP); Tsuneaki Ohashi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 299 days.

(21) Appl. No.: 12/945,076

(22) Filed: Nov. 12, 2010

(65) Prior Publication Data

US 2011/0114352 A1 May 19, 2011

(30) Foreign Application Priority Data

Nov. 13, 2009 (JP) ..... 2009-260023

(51) Int. Cl.
*H01J 5/00* (2006.01)

(52) U.S. Cl.
USPC ..... 174/50; 174/505.5; 174/50.51; 313/634; 313/623; 313/624; 445/26

(58) Field of Classification Search ..... 174/50, 174/520, 17 R, 50.5, 50.51; 313/634, 635, 313/493, 624, 625, 623, 332, 289, 573; 445/26, 445/22; 264/632, 614, 642
See application file for complete search history.

(56) References Cited

U.S. PATENT DOCUMENTS

| | | | | |
|---|---|---|---|---|
| 6,004,503 | A | 12/1999 | Neil | |
| 6,126,887 | A | 10/2000 | Ward et al. | |
| 6,731,066 | B2 * | 5/2004 | Neil et al. | 313/623 |
| 6,979,421 | B2 * | 12/2005 | Neil et al. | 264/642 |
| 7,063,586 | B2 | 6/2006 | Scott et al. | |
| 7,297,037 | B2 * | 11/2007 | Venkataramani et al. | 313/624 |
| 7,382,097 | B2 * | 6/2008 | Seredich et al. | 313/634 |
| 2003/0122490 | A1 | 7/2003 | Seredich et al. | |
| 2005/0194908 | A1 | 9/2005 | Dakin et al. | |
| 2006/0202624 | A1 | 9/2006 | Ramaiah et al. | |
| 2009/0130459 | A1 | 5/2009 | Kuenzler et al. | |

FOREIGN PATENT DOCUMENTS

| | | | |
|---|---|---|---|
| EP | 0 331 154 | A1 | 9/1989 |
| EP | 1 006 552 | A1 | 6/2000 |
| EP | 1 089 321 | A1 | 4/2001 |
| JP | 10-125230 | A1 | 5/1998 |
| JP | 2000-277013 | A1 | 6/2000 |
| JP | 2001-076620 | A1 | 3/2001 |
| JP | 2001-118543 | A1 | 4/2001 |
| JP | 2002-117807 | A1 | 4/2002 |
| JP | 2004-148767 | A1 | 5/2004 |
| JP | 2004-519823 | A1 | 7/2004 |
| JP | 2006-093046 | A1 | 4/2006 |
| JP | 2009-207941 | A1 | 9/2009 |

* cited by examiner

*Primary Examiner* — Angel R Estrada
(74) *Attorney, Agent, or Firm* — Burr & Brown

(57) ABSTRACT

The present invention relates to a ceramic tube for a high-intensity discharge lamp, comprising a hollow member and a plug member. The hollow member contains a substantially cylindrical body and a closure for closing one end of the body, and the plug member is inserted into an insertion opening formed at the other end of the body. Before the insertion of the plug member, the insertion opening has a tapered portion with a diameter decreasing in the direction from the open end to the inside at least in an area into which the plug member is inserted. After the insertion of the plug member, an outer wall of the plug member is bonded to an inner wall of the insertion opening.

14 Claims, 10 Drawing Sheets

CERAMIC TUBE FOR HIGH-INTENSITY DISCHARGE LAMP AND METHOD OF PRODUCING THE SAME

CROSS-REFERENCE TO RELATED APPLICATION

This application is based upon and claims the benefit of priority from Japanese Patent Application No. 2009-260023 filed on Nov. 13, 2009, of which the contents are incorporated herein by reference.

BACKGROUND OF THE INVENTION

1. Field of the Invention

The present invention relates to a ceramic tube for a high-intensity discharge lamp obtained by inserting a plug member into a hollow member and by subjecting the members to a firing treatment, and to a method of producing the ceramic tube for a high-intensity discharge lamp.

2. Description of the Related Art

In ceramic metal halide lamps, a pair of electrodes are inserted into a ceramic tube for a high-intensity discharge lamp (hereinafter referred to simply as the tube), and a metal halide is ionized by the electrodes to show discharge emission.

Various examples of such tubes have been disclosed, and include those produced by assembling a plurality of members, those produced integrally as a single member, and those produced by bonding two members. In FIG. 10, a tube 1 is shown as an example of such tubes. The tube 1 is produced by assembling a hollow member 3 and a plug member 4. The hollow member 3 has an insertion opening 2 at one end and a bottom at the other end, and the plug member 4 is inserted into the insertion opening 2.

In the tube 1, the hollow member 3 contains a substantially cylindrical body 5, a closure 6 for closing one end of the body 5, and a long first electrode insert 7 protruding from one surface of the closure 6. Meanwhile, the plug member 4 contains a disc-shaped portion 8 and a long second electrode insert 9 protruding from one surface thereof. The side wall of the disc-shaped portion 8 is bonded to the inner wall of the insertion opening 2.

The hollow member 3 and the plug member 4 having such structures are generally composed of a translucent alumina ceramic. In FIG. 10, a pair of electrodes (not shown) are inserted into insertion holes 10, 11.

As shown in FIG. 10, the first electrode insert 7 (the insertion hole 10) and the second electrode insert 9 (the insertion hole 11) face each other on a common axis. Therefore, the electrodes (not shown) are arranged facing each other in the insertion holes 10, 11.

As described in Japanese Laid-Open Patent Publication Nos. 2002-117807 and 10-125230, the tube 1 can be obtained by the steps of preparing the hollow member 3 and the plug member 4 separately by extrusion or press forming, firing and shrinking the plug member 4, inserting the disc-shaped portion 8 of the plug member 4 into the open end of the insertion opening 2 in the hollow member 3, and subjecting the hollow member 3 and the inserted plug member 4 to a firing treatment. In the firing treatment, the hollow member 3 is sintered and shrunk, whereby the inner wall of the insertion opening 2 and the side wall of the disc-shaped portion 8 are integrally bonded.

As is clear from FIG. 2 of Japanese Laid-Open Patent Publication No. 2002-117807 and FIG. 2 of Japanese Laid-Open Patent Publication No. 10-125230, the insertion opening 2 in the tube 1 generally has a constant diameter in the vicinity of the open end which the disc-shaped portion 8 is inserted to. In such a structure, the disc-shaped portion 8 is often bonded in the inclined state to the insertion opening 2 as shown in FIG. 10.

This inclination is caused due to the irregularity of positions in which the bonding between the hollow member 3 and the disc-shaped portion 8 is started in the step of sintering and gradually shrinking the hollow member 3. Thus, when in a certain point on the circumference, the bonding of the disc-shaped portion 8 is started not in a position in the vicinity of the inside of the insertion opening 2 but in a position in the vicinity of the inlet side of the insertion opening 2, the hollow member 3 is shrunk in the axis direction toward the bonded position in the vicinity of the inlet side until also the position in the vicinity of the inside is bonded by further shrinkage. When in another point on the circumference, the bonding of the disc-shaped portion 8 is started in a position in the vicinity of the inside of the insertion opening 2, the hollow member 3 is shrunk in the axis direction toward the bonded position in the vicinity of the inside of the insertion opening 2. In a case where such different bonding behaviors are simultaneously caused in different points on the circumference, the ends of the hollow member 3 and the disc-shaped portion 8 are bonded at approximately the same height in the point in which the bonding is started in the vicinity of the inlet side, while the end of the disc-shaped portion 8 protrudes from the hollow member 3 in the point in which the bonding is started in the vicinity of the inside, so that the disc-shaped portion 8 is inclined.

In this case, the axis of the second electrode insert 9 in the plug member 4 is inclined from the axis of the first electrode insert 7 in the hollow member 3. Thus, the electrodes inserted in the insertion holes 10, 11 are not arranged facing each other on a common axis. This may cause the breakage of the member in a process of inserting the electrodes to produce a lamp, and may increase the discharge instability of the lamp. Furthermore, the discharge arc position variation is disadvantageously increased due to the position instability of the electrodes, resulting in difficulty in light distribution control.

In the process of bonding the disc-shaped portion 8 in the plug member 4 to the insertion opening 2 in the hollow member 3, the bonding may be started in a position in the vicinity of the inlet side and in a position in the vicinity of the inside of the insertion opening 2, and then the intermediate position may be bonded thereafter. In this case, a closed space is formed between the bonded positions, air remains in the space, and a cavity is formed in the space in the bonding process, thereby resulting in the generation of a scattered light causing glare and the deterioration of a lamp life. Particularly, when the plug member 4 is prepared by a press forming method, since the disc-shaped portion 8 tends to have a smaller diameter in the intermediate position, this problem is often caused.

In addition, in the tube 1, the closure 6 of the hollow member 3 and the disc-shaped portion 8 of the plug member 4 have the same in-line transmittance lower than that of the body 5 of the hollow member 3, and a light is mainly emitted from the body 5. Therefore, for example, when the tube 1 is used in combination with a reflecting mirror to form a lamp for emitting a light in one direction, the light cannot be emitted in the axis direction of the reflecting mirror disadvantageously, resulting in difficulty in light distribution control.

In view of this disadvantage, Japanese Laid-Open Patent Publication No. 2006-093046 discloses a tube with an improved light distribution property. The tube is obtained by assembling three members, and wherein a portion corresponding to the body of the hollow member and a portion corresponding to the disc-shaped portion of the plug member (or the closure of the hollow member) have different transmittances. However, also this tube cannot emit a light in the axis direction.

SUMMARY OF THE INVENTION

A general object of the present invention is to provide a ceramic tube for a high-intensity discharge lamp, which can reduce the breakage of a member in the production.

A principal object of the present invention is to provide a ceramic tube for a high-intensity discharge lamp, which can be easily equipped with electrodes facing each other.

Another object of the present invention is to provide a ceramic tube for a high-intensity discharge lamp, which can prevent the generation of glare due to a scattered light.

A further object of the present invention is to provide a ceramic tube for high-intensity discharge lamp, which can be easily controlled in terms of light distribution.

According to an aspect of the present invention, there is provided a ceramic tube for a high-intensity discharge lamp, comprising a hollow member and a plug member each containing an electrode insert, to which an electrode is inserted, wherein the hollow member contains a substantially cylindrical body, an opening at one end of the body and a closure for closing another end of the body, the plug member is inserted into the opening, before the insertion of the plug member, the opening has a tapered portion with a diameter decreasing in a direction from an inlet to an inside of the hollow member at least in an area into which the plug member is inserted, and after the insertion of the plug member, an outer wall of the plug member is bonded to an inner wall of the opening.

When the plug member is inserted into the insertion opening having the tapered portion, the bonding is generally started in a position in the vicinity of the inside of the opening because the inner wall of the opening and the outer wall of the plug member are spaced at a small interval in the position in the vicinity of the inside of the opening. Then, the hollow member is shrunk in the axis direction toward the inside on the entire circumference until the plug member is bonded also in the vicinity of the inlet of the opening to complete the bonding. Therefore, the above described inclination of the plug member can be prevented.

Thus, in the present invention, the electrode inserts face each other on a common axis, whereby the electrodes can be easily arranged facing each other in the inserts. In other words, the axes of the electrodes can be easily prevented from being misaligned.

As described above, in the present invention, since the tapered portion is formed in the insertion opening of the hollow member, the axis of the electrode insert in the hollow member can be aligned with the axis of the electrode insert in the plug member inserted into the insertion opening. Therefore, the electrodes can be easily arranged facing each other in the inserts, and an arc can be obtained with stable position and shape.

Furthermore, the bonding proceeds in the direction from the inside to the open end while pushing air out, whereby cavities are not formed in an intermediate position on the outer wall of the plug member. Thus, the remaining of air can be prevented in the closure of the hollow member, and the formation of cavity can be prevented in the connection, whereby the generation of a scattered light can be reduced. In addition, when the hollow member and the plug member have different in-line transmittances, the light distribution can be easily controlled.

In a case where the plug member contains a disc-shaped portion with a substantially constant outer diameter, the above-mentioned advantageous effects are improved particularly remarkably.

In this case, in view of the above effects, it is preferred that an inner wall of the tapered portion is at an angle of 0.5° to 4° to the outer wall of the disc-shaped portion.

It is preferred that a corresponding tapered portion with a diameter decreasing correspondingly with the above tapered portion is formed on the outer wall of the body. In this case, the thickness of the hollow member can be reduced, so that the size and weight of the hollow member (or the ceramic tube for a high-intensity discharge lamp) can be reduced.

It is preferred that a chamfer is disposed between the outer wall of the body and an outer wall of the closure. In the case of using the chamfer, a corresponding chamfer is formed in a mold. The mold having the corresponding chamfer can be more easily filled with a slurry as compared with a right-angled mold. Thus, the generation of air bubbles is prevented in the slurry, whereby a light from the resultant hollow member can be easily controlled with respect to the distribution without scattering.

It is preferred that the hollow member and the plug member have different in-line transmittances. When the body and closure in the hollow member and the disc-shaped portion in the plug member have different in-line transmittances, the light distribution can be easily controlled.

For example, the different in-line transmittances may be obtained by using a press forming method for preparing the plug member and by using a gel casting method for preparing the hollow member. The gel casting method is capable of forming a compact with a more uniform ceramic particle density distribution as compared with the press forming method. When the compact with a uniform density distribution is fired, all parts of the compact can be shrunk at an approximately uniform shrinkage rate to prevent incorporation of fine air bubbles. Thus obtained sintered compact has a dense structure and a high in-line transmittance. At least the hollow member may be prepared from a material with a high transmittance described in Japanese Patent Application No. 2009-207941, etc., to obtain more remarkable effects.

It is more preferred that the hollow member has an in-line transmittance higher than that of the plug member. In this case, the light distribution can be controlled more easily.

Alternatively, the different in-line transmittances may be obtained by using the body, the closure, and the disc-shaped portion of the plug member having different thicknesses.

Thus, for example, the closure may have a thickness smaller than that of the plug member (particularly the disc-shaped portion). In this case, the closure has an in-line transmittance higher than that of the plug member. In this case, when the body has a thickness smaller than that of the closure, the in-line transmittance is increased in the order of the plug member (the disc-shaped portion), the closure, and the body, and the resultant ceramic tube can be easily used in combination with a reflecting mirror to emit a light in one direction. It is difficult to reduce the thickness of the hollow member or to increase the thickness difference in the hollow member in a press or injection forming method. Therefore, the hollow member is preferably prepared by the gel casting method.

It is to be understood that the closure may have a thickness larger than that of the disc-shaped portion of the plug member conversely. In this case, the hollow member has an in-line transmittance lower than that of the plug member.

According to another aspect of the present invention, there is provided a method of producing a ceramic tube for a high-intensity discharge lamp comprising a hollow member and a plug member each containing an electrode insert, to which an electrode is inserted, wherein the hollow member contains a substantially cylindrical body, an opening at one end of the body and a closure for closing another end of the body, the plug member is inserted into the opening, wherein the hollow member has a tapered, diameter-decreasing portion with a diameter decreasing in a direction from an inlet of the opening for the plug member to an inside of the hollow member at least in an area into which the plug member is inserted, wherein the plug member has a disc-shaped portion with a substantially constant outer diameter, and wherein an inner wall of the tapered, diameter-decreasing portion is at an angle of 0.5° to 4° to an outer wall of the disc-shaped portion of the plug member, the method comprising the steps of:

inserting the disc-shaped portion to the opening, and bonding the outer wall of the plug member to the inner wall of the opening.

According to the above-mentioned process, the plug member can be prevented from inclining. Thus, it becomes easy to arrange electrodes as well as electrode inserts to face each other coaxially. As a result, it is possible to prevent axial misalignment between electrodes.

The above and other objects features and advantages of the present invention will become more apparent from the following description when taken in conjunction with the accompanying drawings in which a preferred embodiment of the present invention is shown by way of illustrative example.

DETAILED DESCRIPTION OF THE INVENTION

Preferred embodiments of the ceramic tube of the present invention for a high-intensity discharge lamp and the method of producing the same will be described in detail below with reference to the accompanying drawings. The ceramic tube for a high-intensity discharge lamp may be hereinafter referred to simply as the tube.

Figure 1:
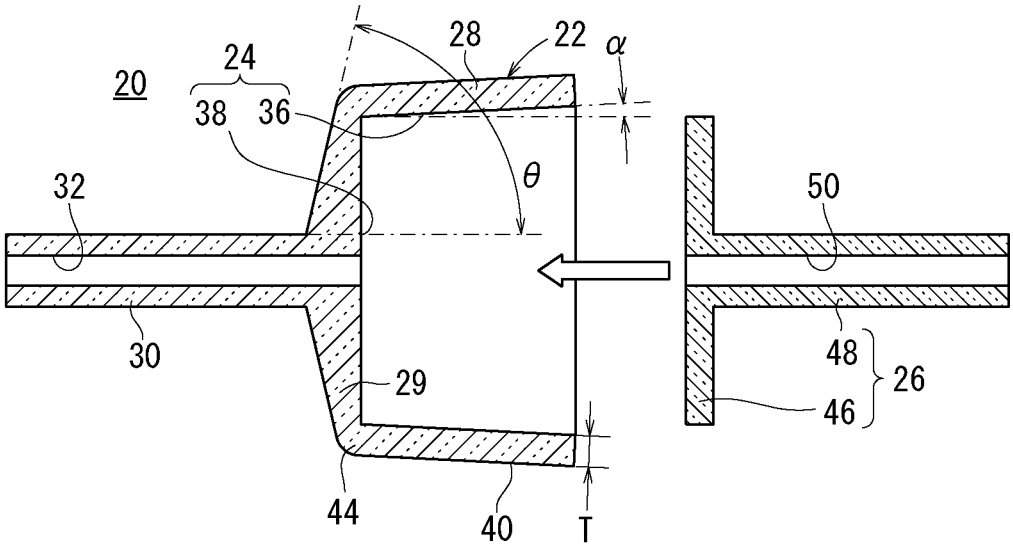
FIG. 1 is a schematic longitudinal cross-sectional view showing a hollow member and a plug member for producing a ceramic tube for a high-intensity discharge lamp according to an embodiment of the present invention, the hollow member having an insertion opening and a bottom, the plug member being inserted into the insertion opening.

FIG. 1 is a schematic longitudinal cross-sectional view showing a hollow member 22 and a plug member 26 for producing a tube 20 according to this embodiment. The hollow member 22 has an insertion opening 24 and a bottom, and the plug member 26 is inserted into the insertion opening 24. In FIG. 1, the hollow member 22 may be a compact or calcine having a shrinkage allowance. The plug member 26 may be a calcine, or alternatively may be a compact having a controlled density and a shrinkage allowance smaller than that of the hollow member 22.

The hollow member 22 contains a substantially bowl-shaped body 28, a closure 29 for closing one end of the body 28, and a long first electrode insert 30 protruding from one surface of the closure 29. An insertion hole 32 is formed in the first electrode insert 30, and a first electrode 34 is introduced into the insertion hole 32 as described hereinafter (see FIG. 7).

An opening is formed at one end of the body 28 to provide the hollow member 22 with the insertion opening 24 and a bottom. The insertion opening 24 has a tapered portion 36 with a diameter gradually decreasing in the direction from the open end to the inside (see FIG. 1). A disc-shaped portion 46 in the plug member 26 is introduced from the open end. The taper angle $\alpha$ of the tapered portion 36 in the insertion opening 24 is preferably 0.5° to 4°, more preferably 0.5° to 2°. In this embodiment, the insertion opening 24 has a bottom 38 with a flat surface.

If the hollow member 22 and the plug member 26 are separately fired, the outer diameter of the disc-shaped portion 46 is 1% to 10% larger than the inner diameter of the insertion opening 24 in the fired members. When the body 28 and the plug member 26 inserted into the insertion opening 24 are simultaneously fired, they are firmly bonded by a pressure generated due to the dimensional difference. When the tapered portion 36 has an excessively large taper angle $\alpha$, the shrink fitting ratio difference between the open end and the inside of the insertion opening 24 is increased, so that the bonding may be insufficient in the vicinity of the open end, or the disc-shaped portion 46 may be excessively fitted into the insertion opening 24, generating a crack in the vicinity of the inside, disadvantageously. On the other hand, when the taper angle $\alpha$ is less than 0.5°, it is difficult to prevent the inclination of the plug member 26 and the formation of a cavity in the connection. Therefore, the taper angle $\alpha$ is preferably within the above range.

A corresponding tapered portion 40 with a diameter gradually decreasing in correspondence with the tapered portion 36 is formed on the outer wall of the body 28. Thus, the diameter of the outer wall of the body 28 is decreased with the diameter reduction of the insertion opening 24. The thickness T of the body 28 (i.e. the distance between the inner and outer walls of the insertion opening 24 in the body 28) is approximately uniform in the entire body 28.

Also, the outer wall of the closure 29 is tapered in the direction from the body 28 toward the first electrode insert 30. The taper angle θ of the closure 29 (the angle between the direction in which the closure 29 extends and the direction in which the first electrode insert 30 extends) is preferably 75° to 85°. Thus, a greatly tapered portion with a taper angle larger than that of the corresponding tapered portion 40 is formed on the closure 29 in an area from the tapered portion 36 to the first electrode insert 30. Incidentally, a chamfer 44 is disposed between the closure 29 and the body 28. That is, the closure 29 and the body 28 are connected by the chamfer 44.

The plug member 26 contains the disc-shaped portion 46 and a long second electrode insert 48 protruding from one surface thereof. The side wall of the disc-shaped portion 46 is bonded to the inner wall of the insertion opening 24. The diameter of the disc-shaped portion 46 is constant in the thickness direction. If the hollow member 22 and the plug member 26 are separately fired, the outer diameter of the disc-shaped portion 46 is larger than the inner diameter of the insertion opening 24 in the fired members. However, the plug member 26 is calcined, or alternatively the firing shrinkage ratio thereof is controlled (reduced to a ratio lower than that of the hollow member 22), so that the outer diameter of the disc-shaped portion 46 is smaller than the inner diameter of the open end of the insertion opening 24 before the assembling.

The advantageous effects can be obtained not only in the case of gradually reducing the inner diameter of the insertion opening 24 in the hollow member 22 but also in the case of gradually reducing the outer diameter of the disc-shaped portion 46 in the plug member 26 to form a tapered shape. However, in the latter case, the bonding is started in a position at a sharp angle, and an excessively high stress is applied to the insertion opening 24 in the shrink fitting. The connection may be cracked or chipped due to the high stress. Thus, the disc-shaped portion 46 preferably has a constant outer diameter (within an error range of plus or minus 0.5°) to prevent the problem.

Figure 7:
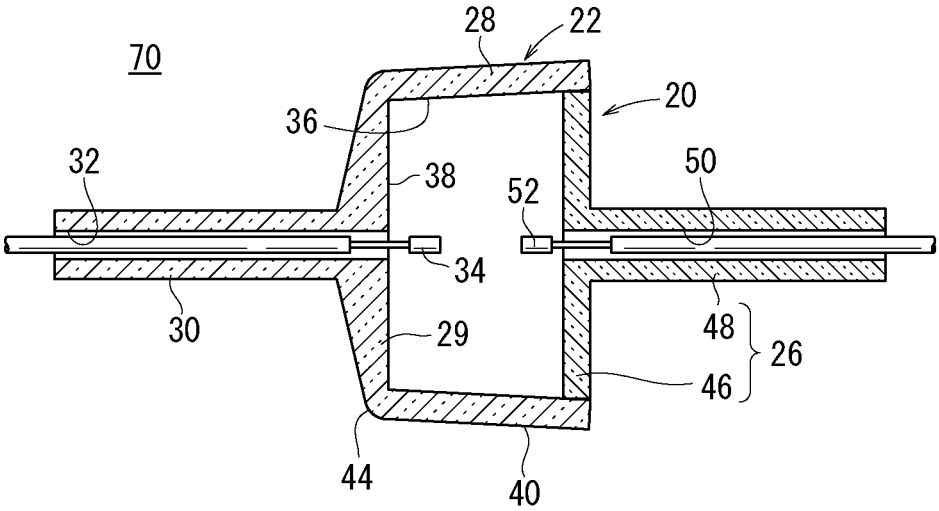
FIG. 7 is a schematic longitudinal cross-sectional view showing a ceramic metal halide lamp produced by inserting a pair of electrodes into the ceramic tube.

An insertion hole 50 is formed in the second electrode insert 48, and a second electrode 52 is introduced into the insertion hole 50 (see FIG. 7).

The materials of the hollow member 22 and the plug member 26 have different transmittances. Thus, the body 28 and the closure 29 in the hollow member 22 are different in in-line transmittance from the disc-shaped portion 46 in the plug member 26. It is preferred that the plug member 26 has a transmittance lower than that of the hollow member 22.

For example, the different transmittances of the hollow member 22 and the plug member 26 may be obtained by making the hollow member 22 denser than the plug member 26. The in-line transmittance is generally increased as the member becomes denser. Specifically, the different transmittances may be obtained in such a manner that the plug member 26 is prepared by a press forming method or the like, and the hollow member 22 is prepared by a gel casting method or the like (a method more suitable for increasing the density than the press forming method). A material with a high transmittance described in Japanese Patent Application No. 2009-207941, etc. may be used to obtain more remarkable effects.

Alternatively, the different transmittances may be obtained by making the closure 29 in the hollow member 22 thinner than the disc-shaped portion 46 in the plug member 26. In this case, in view of increasing the transmittance, the thickness of the body 28 is preferably 0.7 mm or less, more preferably 0.5 mm or less. When the thickness is 0.3 mm or less, the tube 20 cannot be used in a lamp because of poor strength. In view of obtaining the different transmittances, the thickness ratio between the thick and thin portions is preferably 2/1 or more, more preferably 3/1 or more.

For example, the tube 20 having the above structure may be produced as follows.

The hollow member 22 may be prepared by a gel casting method. Thus, a powder of a ceramic or the like for the hollow member 22 is dispersed in a dispersive liquid such as water to prepare a slurry, and the slurry is cast to a mold and hardened therein.

Figure 2:
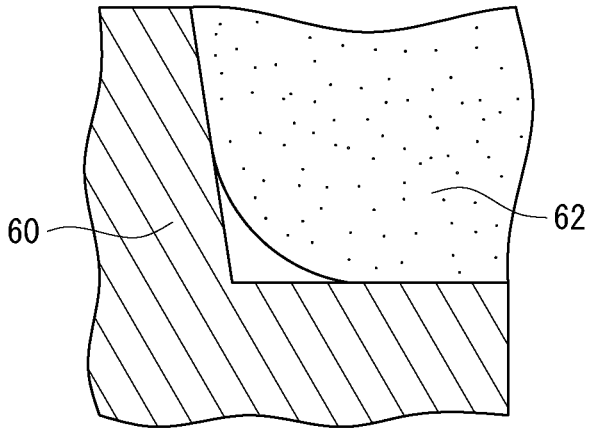
FIG. 2 is a cross-sectional view showing a principal part of a mold having a right-angled portion filled with a slurry.

In a case where the closure 29 and the body 28 intersect at a right angle, as shown in FIG. 2, a portion in a mold 60 for forming the intersection is formed at a right angle. However, in this case, sometimes the mold 60 cannot be sufficiently filled with a slurry 62 for preparing the hollow member 22. In this situation, an air bubble remains in the hollow member 22, whereby an emitted light may undesirably be scattered.

Figure 3:
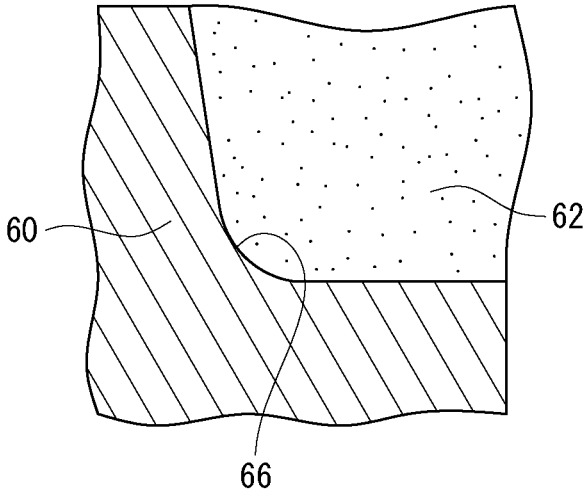
FIG. 3 is a cross-sectional view showing a principal part of a mold having a curved portion (a chamfer) filled with a slurry.

In contrast, in this embodiment, the chamfer 44 is disposed between the closure 29 and the body 28. Therefore, as shown in FIG. 3, a chamfer 66 is formed also in a mold 60. A slurry 62 flows along the chamfer 66, so that the mold 60 is sufficiently filled with the slurry 62. Thus, the air bubble generation and the light scattering in the hollow member 22 can be prevented in the embodiment.

In view of achieving this advantageous effect, the closure 29 preferably has a taper angle θ of 75° to 85°. When the taper angle θ is less than 75°, the heat capacity of the closure 29 is increased, and the lamp efficiency is deteriorated. On the other hand, when the taper angle θ is more than 85°, it is difficult to prevent the air bubble generation.

The plug member 26 may be prepared by a press forming method. Of course it may be prepared by a gel casting method.

When the outer diameter of the disc-shaped portion 46 in the prepared plug member 26 is larger than the inner diameter of the insertion opening 24 in the hollow member 22, the plug member 26 is subjected to a calcination treatment. The plug member 26 is sintered and sufficiently shrunk by the calcination treatment. When the firing shrinkage ratio of the plug member 26 is controlled, and the outer diameter of the disc-shaped portion 46 is smaller than the inner diameter of the insertion opening 24, the calcination treatment is not required.

The disc-shaped portion 46 of the plug member 26 is inserted into the insertion opening 24 of the hollow member 22 to prepare an assembly for producing the tube 20.

As described above, the diameter of the disc-shaped portion 46 is smaller than the diameter of the open end of the insertion opening 24, and the insertion opening 24 has the tapered portion 36 with the decreasing diameter. When the plug member 26 and the hollow member 22 in the assembly are simultaneously calcined, the gap between the members is gradually reduced, and then the members are brought into contact with each other. This is because the plug member 26 is calcined (or controlled with respect to the firing shrinkage ratio) beforehand, and the hollow member 22 is shrunk at a higher shrinkage ratio than the plug member 26.

Figure 4:
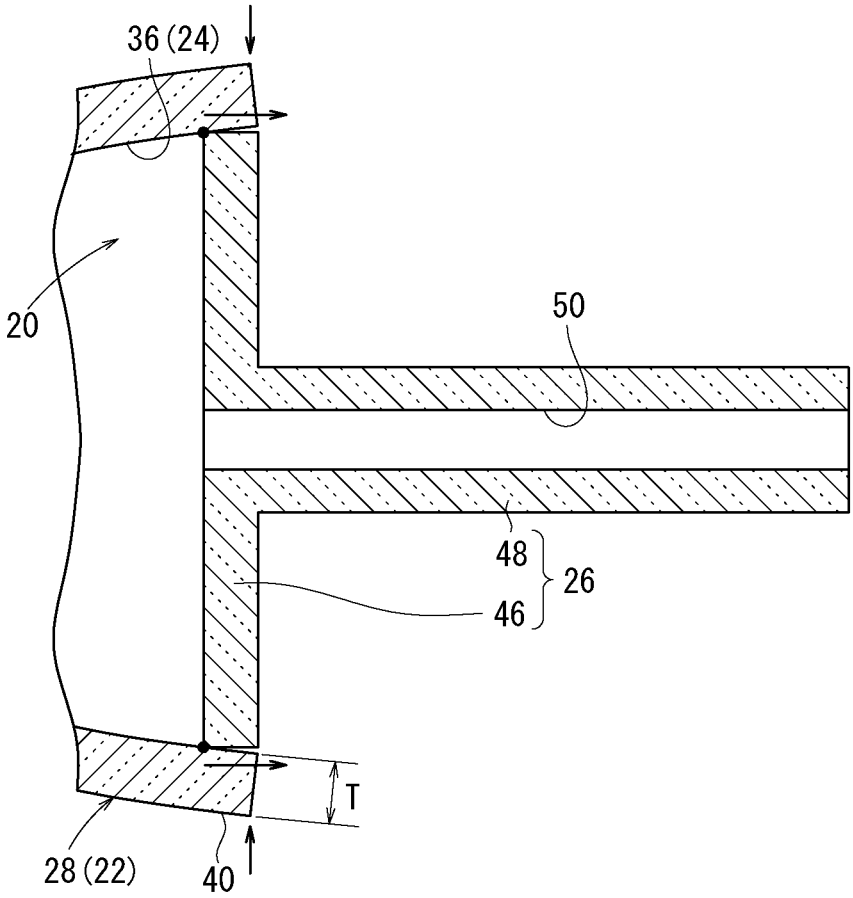
FIG. 4 is an enlarged longitudinal cross-sectional view showing a principal part of the process of bringing the side wall of a disc-shaped portion in the plug member into point contact with the inner wall of the insertion opening in the hollow member.

The disc-shaped portion 46 is in contact with the inner wall of the insertion opening 24 in inside positions represented by black points (●) in the cross-sectional view of FIG. 4, and the bonding is started in the inside positions. The disc-shaped portion 46 and the body 28 are positioned and fixed by the contact and bonding.

Figure 5:
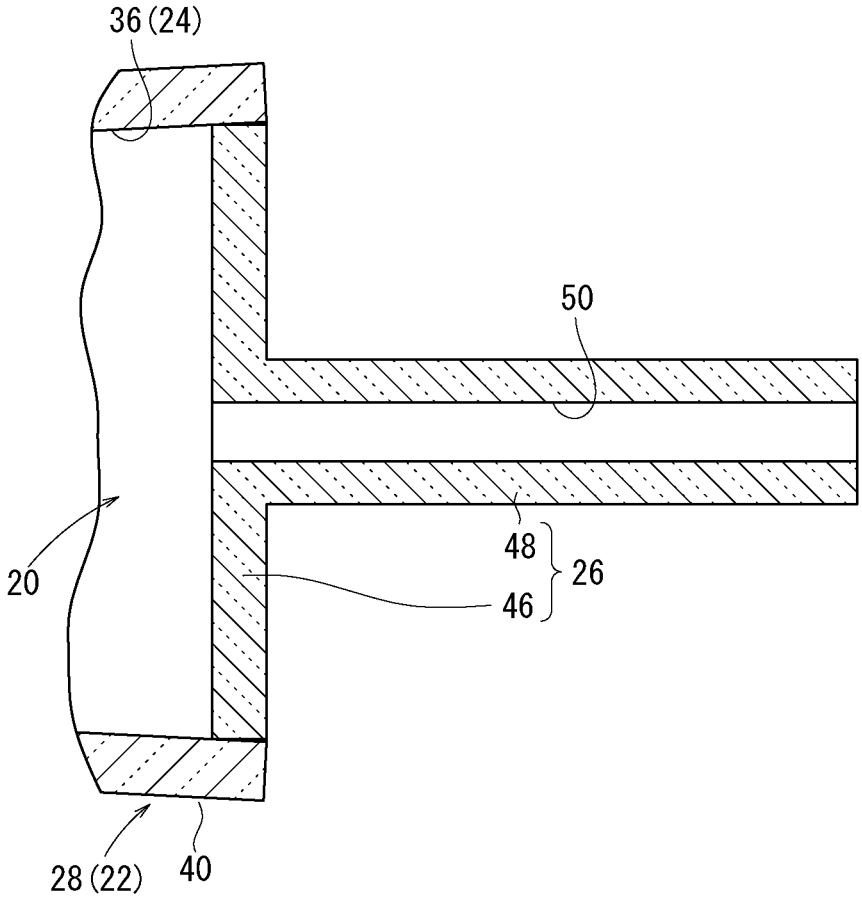
FIG. 5 is an enlarged longitudinal cross-sectional view showing a principal part of the process of bonding the side wall of the disc-shaped portion to the inner wall of the insertion opening.

The shrinkage of the hollow member 22 is continued even after the bonding is started. The body 28 is shrunk in the axis direction toward the inside positions represented by the black points (●) in FIG. 4, in which the members are positioned and fixed by the bonding. Thus, the bonded region is expanded from the positions (the inside of the insertion opening 24) toward the open end. Finally, as shown in FIG. 5, the entire outer wall of the plug member 26 is bonded to the inner wall of the hollow member 22 by the circumferential shrinkage to obtain a bonded assembly. Inside the tapered portion 36 with the decreasing diameter, a firing shrinkage force against the plug member 26 is relatively great. On the other hand, at the inlet of the tapered portion 36 with the decreasing diameter, the firing shrinkage force against the plug member 26 is relatively low. The bonded assembly is subjected to a firing treatment in this state.

Figure 6:
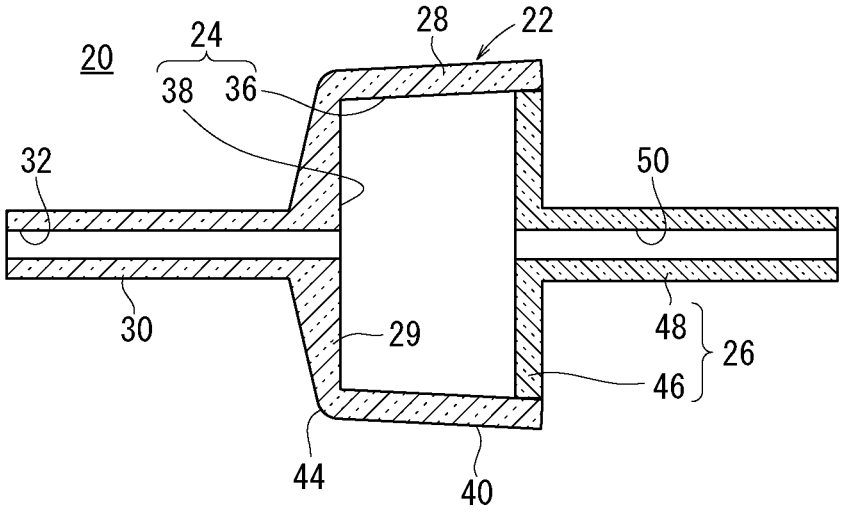
FIG. 6 is a schematic longitudinal cross-sectional view showing the ceramic tube for a high-intensity discharge lamp, produced by bonding the side wall of the disc-shaped portion to the inner wall of the insertion opening.

The side wall of the disc-shaped portion 46 and the inner wall of the insertion opening 24, in surface contact with each other, are integrated in the process of the firing treatment. Thus, as shown in FIG. 6, the bonding of the side wall of the plug member 26 to the inner wall of the insertion opening 24 is completed to produce the tube 20. The tapered portion 36 with the decreasing diameter remains in the tube 20 (see FIG. 5).

In the tube 20, the first electrode insert 30 and the second electrode insert 48 face each other. In other words, they are aligned on a common axis. When the disc-shaped portion 46 is brought into contact with the inner wall of the insertion opening 24 (the tapered portion 36) in the inside positions represented by the black points (●) in FIG. 4, the first electrode insert 30 and the second electrode insert 48 are aligned on a common axis. Then the bonding proceeds in the direction from the inside to the open end gradually, whereby the disc-shaped portion 46 is bonded to the inner wall of the insertion opening 24.

A cavity is not formed in the connection of the tube 20. This is because air is not contained in the closed connection as described above.

Then, as shown in FIG. 7, the first electrode 34 is inserted into the first electrode insert 30, and the second electrode 52 is inserted into the second electrode insert 48, to obtain a ceramic metal halide lamp 70. Since the first electrode insert 30 and the second electrode insert 48 are aligned on a common axis as described above, the first electrode 34 and the second electrode 52 face each other on a common axis.

In the embodiment, the first electrode 34 and the second electrode 52 can be arranged facing each other in this manner.

In the ceramic metal halide lamp 70, an electric field is applied between the first electrode 34 and the second electrode 52 to ionize a metal halide contained in the insertion opening 24. The discharge emission can be obtained with the ionization.

In this embodiment, an air bubble is hardly generated in the hollow member 22, and a cavity is hardly formed in the connection as described above. In other words, the hollow member 22 contains few air bubbles, and the connection contains few cavities. Thus, the tube 20 can be prevented from cracking from the air bubble or cavity due to a thermal shock in an emission process, and the lamp 70 can be prevented from being deteriorated in life due to leak. In addition, the light scattering due to the air bubble or cavity can be prevented.

An appropriate light distribution can be effectively obtained by preventing the light scattering because the light distribution is deteriorated by a scattered light.

When the hollow member 22 has an in-line transmittance higher than that of the plug member 26, the light distribution can be easily controlled. Thus, the light distribution control can be easily carried out by utilizing the in-line transmittance difference without attaching a light shielding film, a metal plate, etc. for removing a glare-causing part from the emitted light.

When the chamfer 44 is disposed (a curved portion is formed) between the body 28 and the closure 29, the light scattering can be further reduced, whereby the light distribution can be preferably further improved.

The hollow member 22 may have a thickness smaller than that of the plug member 26 differently from the above embodiment. In this case, the transmittance of the hollow member 22 is increased, and a light emission from the hollow member 22 can be easily utilized. Furthermore, a light emission from the plug member 26 is reduced, and the light distribution can be improved.

Figure 8:
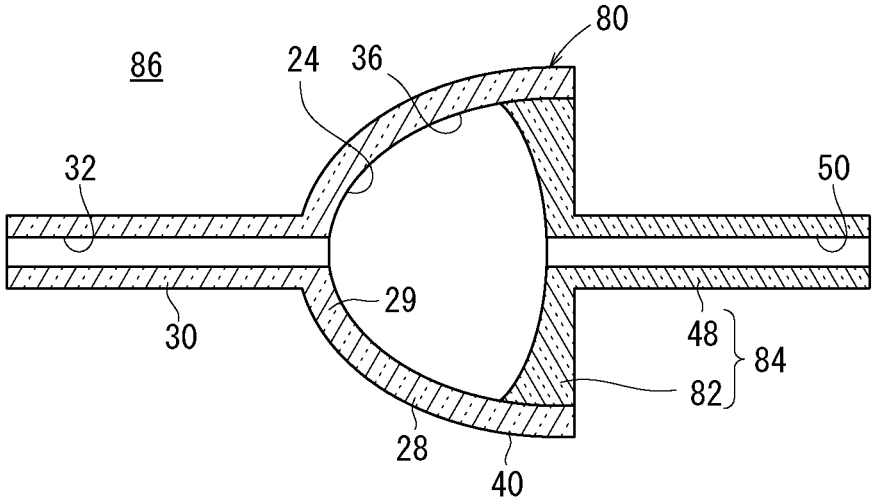
FIG. 8 is a schematic longitudinal cross-sectional view showing a ceramic tube for a high-intensity discharge lamp according to another embodiment of the present invention.

The ceramic tube of the present invention includes a tube 86 shown in FIG. 8 produced by combining a substantially semielliptical hollow member 80 and a plug member 84. The plug member 84 contains a curved closure 82 having a curved concave surface facing an insertion opening 24 of the hollow member 80.

Figure 9:
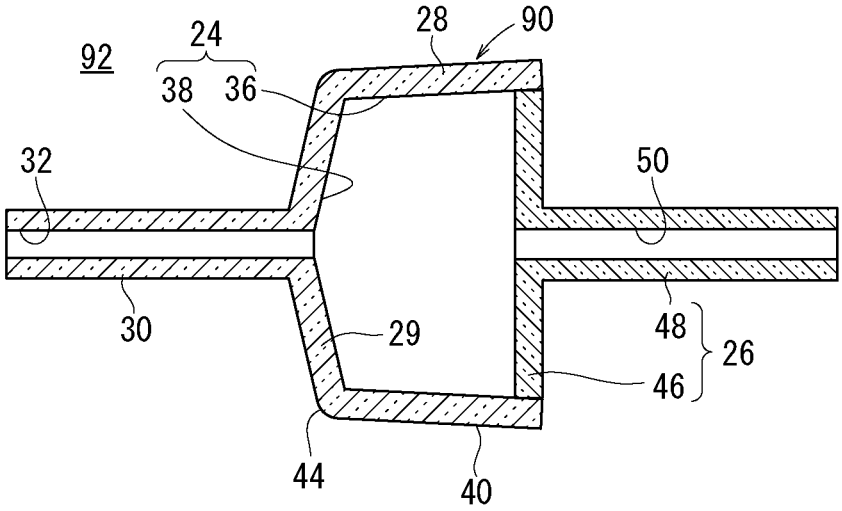
FIG. 9 is a schematic longitudinal cross-sectional view showing a ceramic tube for a high-intensity discharge lamp according to a further embodiment of the present invention.
Figure 10:
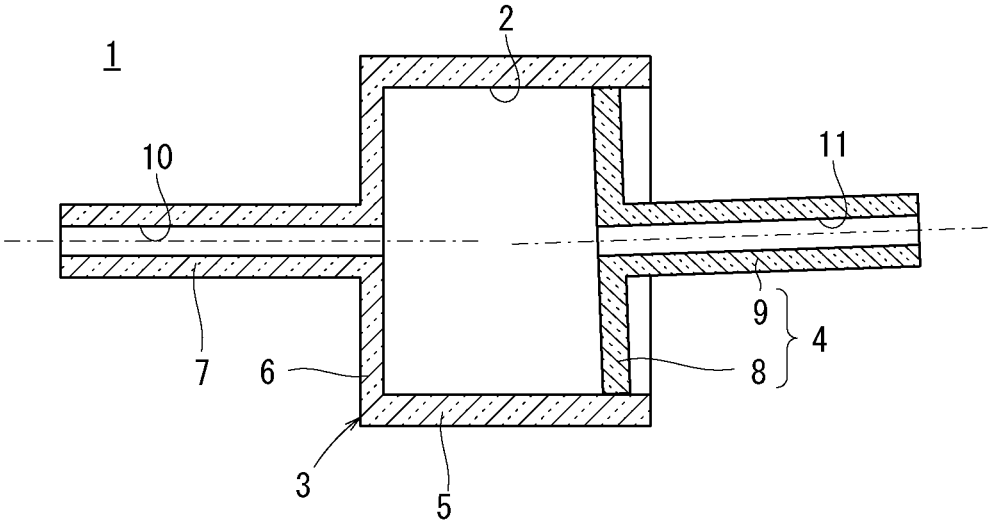
PRIOR ART FIG. 10
FIG. 10 is a schematic longitudinal cross-sectional view showing a ceramic tube for a high-intensity discharge lamp according to a related art.

The ceramic tube of the present invention includes a tube 92 shown in FIG. 9 containing a hollow member 90 having a particular closure 29. The inner wall of the closure 29 (a bottom 38 of an insertion opening 24) has a diameter decreasing in the direction toward a first electrode insert 30 to form a tapered shape. In the tube 92, a first electrode 34 is disposed at a large distance from the inner wall of the closure 29 (the bottom 38 of the insertion opening 24). Thus, in an emission process, the tube 92 has an approximately uniform temperature distribution, and the color temperature is advantageously stabilized to improve the lamp characteristics.

EXAMPLE 1

The ceramic tube for a high-intensity discharge lamp shown in FIG. 1 was produced by the above described method. A slurry for the hollow member 22 was prepared by mixing the following components.

(Raw Material Powder)

100 parts by weight of an α-alumina powder having a specific surface area of 3.5 to 4.5 $m^2/g$ and an average primary particle diameter of 0.35 to 0.45 μm 0.025 parts by weight of MgO (magnesia)

0.040 parts by weight of $ZrO_2$ (zirconia)

0.0015 parts by weight of $Y_2O_3$ (yttria)

(Dispersion Medium)

27 parts by weight of dimethyl glutarate 0.3 parts by weight of ethylene glycol (Gelling Agent)

4 parts by weight of an MDI resin (Dispersing Agent)

3 parts by weight of a macromolecular surfactant (Catalyst)

0.1 parts by weight of N,N-dimethylaminohexanol

The slurry was cast into an aluminum alloy mold at the room temperature. The slurry was left in the mold at the room temperature for 1 hour and at 40° C. for 30 minutes to perform the solidification. The resultant solid was separated from the mold, and was let stand at the room temperature for 2 hours and at 90° C. for 2 hours, to obtain the hollow member 22. The insertion opening 24 had a taper angle α of 0.5° in an area to be bonded to the plug member 26, the closure 29 had a taper angle θ of 85°, the chamfer 44 was formed between the body 28 and the closure 29, and the body 28 had a thickness of 0.5 mm.

Then, a slurry was prepared by mixing the following components to obtain a powder for forming the plug member 26.

(Raw Material Powder)

100 parts by weight of an α-alumina powder having a specific surface area of 3.5 to 4.5 $m^2/g$ and an average primary particle diameter of 0.35 to 0.45 μm 0.025 parts by weight of MgO (magnesia)

0.040 parts by weight of $ZrO_2$ (zirconia)

0.0015 parts by weight of $Y_2O_3$ (yttria)

(Dispersion Medium)

50 parts by weight of pure water (Granulation Binder)

2 parts by weight of a PVA resin 0.5 parts by weight of a PEG resin.

The slurry was pulverized and mixed for 1 hour using a ball mill. The resultant mixture was dried at about 200° C. by a spray dryer to obtain a granulated powder having an average particle diameter of approximately 70 μm.

The granulated powder was press-formed under a pressure of 1000 $kg/cm^2$ to obtain the plug member 26. The disc-shaped portion 46 had a constant outer diameter and a thickness of 1.5 mm.

Incidentally, the sizes of the hollow member 22 and the plug member 26 were controlled such that when the hollow member 22 and the plug member 26 were separately fired, the outer diameter of the disc-shaped portion 46 is 1.001 to 1.010 times larger than the inner diameter of the insertion opening 24 in the fired members.

The plug member 26 was calcined and shrunk at 1200° C., and the disc-shaped portion 46 was inserted into the insertion opening of the hollow member 22 to obtain an assembly. The hollow member 22 was shrunk by calcining the assembly at 1200° C., whereby the hollow member 22 and the plug member 26 were bonded to obtain a bonded assembly.

The bonded assembly was fired at 1800° C. in a hydrogen atmosphere, whereby the hollow member 22 and the plug member 26 were integrated to obtain the ceramic tube 20 for a high-intensity discharge lamp.

In the tube 20, the first electrode insert 30 and the second electrode insert 48 had a coaxiality of 0.3 mm. Cavities were not formed in the connection of the tube 20, and air bubbles were not observed in the closure 29 of the hollow member 22.

The in-line transmittance of each part of the tube 20 was measured. As a result, in the plug member 26, the disc-shaped portion 46 had an in-line transmittance of 1% or less, and a light was hardly transferred therethrough. In the hollow member 22, the body 28 had an in-line transmittance of 15%, and the closure 29 had an in-line transmittance of 8%. Scattered lights were not observed.

EXAMPLES 2 TO 4

Three ceramic tubes 20 for a high-intensity discharge lamp were produced in the same manner as in Example 1 except that the taper angle α of the insertion opening 24 in the hollow member 22 was changed to 1°, 2°, and 4°, respectively.

In the tubes 20, the first electrode insert 30 and the second electrode insert 48 had a coaxiality of 0.2 mm. The cavity ratios of the connections were 0%, 0%, and 10%, respectively. Air bubbles were not observed in the closure 29 of the hollow member 22.

The in-line transmittance of each part of each tube 20 was measured. As a result, in the plug member 26, the disc-shaped portion 46 had an in-line transmittance of 1% or less, and a light was hardly transferred therethrough. In the hollow member 22, the body 28 had an in-line transmittance of 15%, and the closure 29 had an in-line transmittance of 8%. Scattered lights were not observed.

EXAMPLE 5

A ceramic tube 20 for a high-intensity discharge lamp was produced in the same manner as in Example 1 except that the taper angle θ of the closure 29 was changed to 75°. In the tube 20, the first electrode insert 30 and the second electrode insert 48 had a coaxiality of 0.3 mm. Cavities were not formed in the connection of the tube 20, and air bubbles were not observed in the closure 29 of the hollow member 22.

The in-line transmittance of each part of the tube 20 was measured. As a result, in the plug member 26, the disc-shaped portion 46 had an in-line transmittance of 1% or less, and a light was hardly transferred therethrough. In the hollow member 22, the body 28 had an in-line transmittance of 15%, and the closure 29 had an in-line transmittance of 8%. Scattered lights were not observed.

EXAMPLE 6

The hollow member 22 was prepared in the same manner as in Example 1, and the plug member 26 was prepared from the slurry for the hollow member 22. Then, the members were assembled and bonded in the same manner as in Example 1 to produce a ceramic tube 20 for a high-intensity discharge lamp. In the hollow member 22, the insertion opening 24 had a taper angle of 1°, the body 28 had a thickness of 0.5 mm, and the closure 29 was formed in an ellipsoid shape. The disc-shaped portion 46 in the plug member 26 had a thickness of 1.5 mm.

In the tube 20, the first electrode insert 30 and the second electrode insert 48 had a coaxiality of 0.2 mm. Cavities were not formed in the connection of the tube 20, and air bubbles were not observed in the closure 29 of the hollow member 22.

The in-line transmittance of each part of the tube 20 was measured. As a result, in the plug member 26, the disc-shaped portion 46 had an in-line transmittance of 1% or less, and a light was hardly transferred therethrough. In the hollow member 22, both the body 28 and the closure 29 had an in-line transmittance of 15%. Scattered lights were not observed.

EXAMPLE 7

A ceramic tube 20 for a high-intensity discharge lamp was produced in the same manner as in Example 6 except that the thicknesses of the body 28 and the disc-shaped portion 46 were changed to 0.7 and 1.4 mm, respectively.

In the tube 20, the first electrode insert 30 and the second electrode insert 48 had a coaxiality of 0.2 mm. Cavities were not formed in the connection of the tube 20, and air bubbles were not observed in the closure 29 of the hollow member 22.

The in-line transmittance of each part of the tube 20 was measured. As a result, in the plug member 26, the disc-shaped portion 46 had an in-line transmittance of 1% or less, and a light was hardly transferred therethrough. In the hollow member 22, both the body 28 and the closure 29 had an in-line transmittance of 10%. Scattered lights were not observed.

Comparative Example 1

A ceramic tube for a high-intensity discharge lamp was produced in the same manner as in Example 1 except that the insertion opening in the hollow member had a taper angle α of 0°, the closure in the hollow member had a taper angle θ of 90°, and a chamfer was not formed between the body and the closure.

In the tube, the first electrode insert and the second electrode insert had a coaxiality of 0.8 mm. The cavity ratio of the connection was 25% based on the entire area, and a plurality of air bubbles were observed in the closure of the hollow member.

The in-line transmittance of each part of the tube was measured. As a result, the disc-shaped portion in the plug member had an in-line transmittance of 1% or less, the body in the hollow member had an in-line transmittance of 15%, and a light was hardly transferred therethrough. However, the in-line transmittance of the closure varied within the range of 0% to 8%, and a scattered light was observed in the closure.

Comparative Example 2

A ceramic tube for a high-intensity discharge lamp was produced in the same manner as in Example 1 except that the insertion opening in the hollow member had a taper angle of 5°, and the closure in the hollow member had a taper angle of 70°.

In the tube, the first electrode insert and the second electrode insert had a coaxiality of 0.2 mm. Significant cavities were formed in the connection particularly in the vicinity of the open end of the insertion opening, and the cavity ratio of the connection was 50% or more based on the entire area. Air bubbles were not observed in the closure of the hollow member.

The in-line transmittance of each part of the tube was measured. As a result, in the plug member, the disc-shaped portion had an in-line transmittance of 1% or less, and a light was hardly transferred therethrough. In the hollow member, the body had an in-line transmittance of 15%, and the closure had an in-line transmittance of lower than 1%. Scattered lights were not observed.

The results are shown in Table 1.

TABLE 1

| | Example 1 | Example 2 | Example 3 | Example 4 | Example 5 | Example 6 | Example 7 | Comparative Example 1 | Comparative Example 2 |
|---|---|---|---|---|---|---|---|---|---|
| Preparation of hollow member | Gel casting | ← | ← | ← | ← | ← | ← | ← | ← |
| Preparation of plug member | Press forming | ← | ← | ← | ← | Gel casting | ← | Press forming | ← |
| Taper angle α of insertion opening | 0.5° | 1° | 2° | 4° | 0.5° | 1° | ← | 0° | 5° |
| Taper angle θ of closure | 85° | ← | ← | ← | 75° | Ellipsoid | ← | 90° | 70° |
| Thickness of body | 0.5 mm | ← | ← | ← | ← | ← | 0.7 mm | 0.5 mm | ← |
| Thickness ratio between thin and thick portions | 1:3 | ← | ← | ← | ← | ← | 1:2 | 1:3 | ← |
| Coaxiality of electrode inserts | 0.3 mm | 0.2 mm | 0.2 mm | 0.2 mm | 0.3 mm | 0.2 mm | 0.2 mm | 0.8 mm | 0.2 mm |
| Cavity ratio of connection | 0 | 0 | 0 | 0.1 | 0 | 0 | 0 | 0.25 | >50% |
| Air bubble in closure of hollow member | Not observed | Not observed | Not observed | Not observed | Not observed | Not observed | Not observed | observed | Not observed |
| In-line transmittance of plug member | <1% | ← | ← | ← | ← | ← | ← | ← | ← |
| In-line transmittance of body of hollow member | 15% | ← | ← | ← | ← | ← | 10% | 15% | ← |
| In-line transmittance of closure of hollow member | 8% | ← | ← | ← | 3% | 15% | 10% | 0% to 8% | <1% |
| Scattered light in closure of hollow member | Not observed | ← | ← | ← | ← | ← | ← | observed | Not observed |

Although certain preferred embodiments of the present invention have been shown and described in detail, it should be understood that various changes and modifications may be made therein without departing from the scope of the appended claims.

What is claimed is:

1. A ceramic tube for a high-intensity discharge lamp, comprising:

a hollow member and a plug member, each containing an electrode insert into which an electrode is inserted;

wherein the hollow member comprises a substantially cylindrical body having an opening at one end of the body and a closure for closing another end of the body;

wherein the plug member comprises a disc-shaped portion with a substantially constant outer diameter;

wherein the plug member is inserted into the opening of the hollow member;

wherein, before the insertion of the plug member, the opening has a tapered portion with a diameter decreasing in a direction from an inlet to an inside of the hollow member at least in an area into which the plug member is inserted; and wherein, after the insertion of the plug member, an outer wall of the plug member is bonded to an inner wall of the opening.

2. The ceramic tube according to claim 1, wherein an inner wall of the tapered portion is at an angle of 0.5° to 4° to an outer wall of the disc-shaped portion in the plug member.

3. The ceramic tube according to claim 1, wherein a corresponding tapered portion with a diameter decreasing correspondingly with the tapered portion is formed on an outer wall of the body, and a greatly tapered portion with a taper angle larger than that of the corresponding tapered portion is formed on an outer wall of the closure between the tapered portion and the electrode insert.

4. The ceramic tube according to claim 3, wherein a chamfer is disposed between the outer wall of the body and the outer wall of the closure.

5. The ceramic tube according to claim 1, wherein the hollow member and the plug member have different in-line transmittances.

6. The ceramic tube according to claim 5, wherein the body and the closure in the hollow member have a higher in-line transmittance than that of the plug member.

7. The ceramic tube according to claim 5, wherein the body, the closure, and the plug member have different in-line transmittances.

8. The ceramic tube according to claim 5, wherein the hollow member is produced by a gel casting method, and the plug member is produced by a press forming method.

9. The ceramic tube according to claim 5, wherein materials of the hollow member and the plug member have different transmittances.

10. The ceramic tube according to claim 5, wherein the plug member has a lower transmittance than that of the hollow member.

11. The ceramic tube according to claim 5, wherein the hollow member and the plug member have different thicknesses.

12. The ceramic tube according to claim 11, wherein the hollow member has a larger thickness than that of the plug member, and the hollow member has a lower in-line transmittance than that of the plug member.

13. The ceramic tube according to claim 11, wherein the hollow member has a smaller thickness than that of the plug member, and the hollow member has a higher in-line transmittance higher than that of the plug member.

14. A method of producing a ceramic tube for a high-intensity discharge lamp comprising a hollow member and a plug member, each containing an electrode insert into which an electrode is inserted, wherein the hollow member comprises a substantially cylindrical body having an opening at one end of the body and a closure for closing another end of the body, wherein the plug member is inserted into the opening, wherein the hollow member has a tapered, diameter-decreasing portion with a diameter decreasing in a direction from an inlet of the opening for the plug member to an inside of the hollow member at least in an area into which the plug member is inserted, wherein the plug member has a disc-shaped portion with a substantially constant outer diameter, and wherein an inner wall of the tapered, diameter-decreasing portion is at an angle of 0.5° to 4° to an outer wall of the disc-shaped portion of the plug member, the method comprising the steps of:

inserting the disc-shaped portion to the opening; and bonding the outer wall of the plug member to the inner wall of the opening.

* * * * *